US005390776A

United States Patent [19]

Thompson

[11] Patent Number: 5,390,776

[45] Date of Patent: Feb. 21, 1995

[54] DEVICE FOR ROUTING COINS

[75] Inventor: Trevor Thompson, Nr. Andover, United Kingdom

[73] Assignee: Mars, Incorporated, McLean, Va.

[21] Appl. No.: 119,052

[22] PCT Filed: Feb. 18, 1992

[86] PCT No.: PCT/GB92/00286

§ 371 Date: Sep. 15, 1993

§ 102(e) Date: Sep. 15, 1993

[87] PCT Pub. No.: WO92/16917

PCT Pub. Date: Oct. 1, 1992

[30] Foreign Application Priority Data

Mar. 21, 1991 [GB] United Kingdom ..... 9106010

[51] Int. Cl.[6] ..... G07F 1/04

[52] U.S. Cl. ..... 194/346

[58] Field of Search ..... 194/344, 346; 453/3, 453/4; 193/31 A, DIG. 1

[56] References Cited

U.S. PATENT DOCUMENTS

| | | | |
|---|---|---|---|
| 886,499 | 5/1908 | Harrison | 194/346 X |
| 1,428,244 | 9/1922 | Kross | 194/346 X |
| 2,390,147 | 12/1945 | Hatton | 194/346 X |
| 3,040,887 | 6/1962 | Cornelison | 453/4 X |
| 3,092,308 | 6/1963 | Barnhart | 194/346 X |
| 3,104,001 | 9/1963 | Barnhart et al. | 194/346 |
| 3,401,780 | 9/1968 | Jullien-Davin | 194/346 X |
| 3,788,440 | 1/1974 | Propice et al. | 453/3 X |
| 3,916,922 | 11/1975 | Prümm | 453/3 |
| 4,082,099 | 4/1978 | Iwersen | 453/4 |
| 4,393,972 | 7/1983 | Maloy | 194/346 |
| 4,503,961 | 3/1985 | Chittleborough . | |
| 4,664,245 | 5/1987 | Maloy et al. | 194/346 X |
| 4,783,073 | 11/1988 | Kazumi | 194/346 X |

FOREIGN PATENT DOCUMENTS

| | | | |
|---|---|---|---|
| 1449298 | 11/1968 | Germany | 194/346 |
| 4001188 | 7/1990 | Germany . | |
| 5002674 | 1/1993 | Japan | 453/3 |
| 0904947 | 9/1962 | United Kingdom . | |
| 1415559 | 11/1975 | United Kingdom . | |
| 2252856 | 8/1992 | United Kingdom . | |

*Primary Examiner*—Michael S. Huppert
*Assistant Examiner*—Scott L. Lowe
*Attorney, Agent, or Firm*—Davis Hoxie Faithfull & Hapgood

[57] ABSTRACT

A device for selectively routing coins moving edgewise on to either of two paths is described. The device contains a flap lying generally in the plane of movement of a coin, the flap being pivoted such that its upstream end is selectively movable between two positions to cause the coin to go either to one side or to the other side of the flap depending upon the position of the flap, a coin support arranged to support a coin going to the one side of the flap, so that the coin continues edgewise past the flap, and an opening into which a coin going to the other side of the flap will fall edgewise.

10 Claims, 1 Drawing Sheet

DEVICE FOR ROUTING COINS

FIELD OF THE INVENTION

This invention relates to the routing of moving coins in coin handling equipment, and provides a device and apparatus for that purpose.

BACKGROUND OF THE INVENTION

In goods vending machines, gaming machines, and other applications it is well known to provide a coin mechanism which includes an electronic coin validator which can determine the authenticity and denomination of inserted coins, storage means, normally in the form of respective tubes for storing accepted coins of respective different denominations, a coin routing apparatus controlled by signals from the validator indicative of the denomination of each coin and operable to cause the coin to be delivered to the correct tube, and a payout system for paying out coins stored in the tubes, either as change or as prize money.

The present invention is concerned with devices and apparatus which may be utilised in routing coins, for example from the validator to the coin tubes of a coin mechanism such as that just referred to.

It has been common for such coin mechanisms to have four or perhaps more coin tubes standing vertically and arranged in a row. Different coin denominations have been separated from each other by means of a plurality of solenoid-operated gates which define different routes for different coin denominations when they are actuated in different combinations.

The passageways along which coins travel in such coin mechanisms are almost always arranged so that the coins travel edgewise at least through the validating and coin routing parts of the mechanism. One type of gate which has been used frequently in routing the coins is often referred to as a "flipper" gate and comprises a flap which is pivoted such that its upstream end (relative to the direction of travel of coins) is selectively movable between two positions to cause the coin to go either to one side or to the other side of the flap depending on the position of the flap. This is a very simple arrangement and it is easy to move the flap between its two positions using a solenoid.

Because of the nature of that type of gate, coins leaving the flap on one side of it will be on a path only a few millimetres, or a few coin thicknesses, away from coins which leave the other side of the flap the two coins then travelling in planes generally parallel to each other but not spaced far apart. The coin tubes, into the tops of which the coins need to be routed, are of necessity on centres spaced apart by distances of the order of at least a typical coin diameter. It has therefore been necessary to provide, in addition to a gating arrangement which causes initial separation of the coin paths, a manifold section which spreads the paths further apart so as to match them to the positions of the tops of the coin tubes. The need for both separation and manifolding requires a substantial amount of vertical space within the coin mechanism. The overall size of a coin mechanism is constrained by industry standards and machine design requirements, and it is desirable within that constraint to maximise the space available for coin storage and consequently to minimise the space occupied by the other components of the system, including the coin routing and manifolding arrangements.

SUMMARY OF THE INVENTION

The invention provides a device for selectively routing coins moving edgewise on to either of two paths, comprising a flap lying generally in the plane of movement of a coin, the flap being pivotable about an axis such that its upstream end is selectively movable between two positions to cause the coin to go either to one side or to the other side of the flap depending upon the position of the flap, an electrically powered actuator for selectively moving the flap between the two positions, a coin support arranged to support, from below and at its edge, a coin going to said one side of the flap, so that the coin continues edgewise and on edge on the support past the flap, and an opening into which a coin going to said other side of the flap will fall edgewise, characterised in that the device is arranged such that a coin going to said other side of the flap will begin thus to fall at a position upstream of the pivot axis.

Although a simple and compact "flipper" type of gate is used, coins leaving the flap on the two different routes follow paths which over a short distance become spaced fairly widely apart, by much more than the few millimetres of spacing normally associated with the use of "flipper" gates. There is a wide angular divergence of the two paths in the plane in which the coin was originally travelling, in addition to a relatively small and not particularly significant divergence in the direction perpendicular to that plane. This enables a reduction in the total volume taken up for the purpose of separating and manifolding coins of two different denominations.

In a particular form, the invention provides apparatus for selectively routing coins moving edgewise onto any one of four paths, comprising means for selectively directing arriving coins onto either of two paths which diverge in the plane of movement of the coins, and a respective device of the type in accordance with the invention as defined earlier, arranged to receive coins directed to each of said two diverging paths.

In an embodiment to be described, a particular type of V-shaped gate is used to achieve the initial selective direction onto either of two divergent paths and it will become apparent that in conjunction with two "flipper" type gates in accordance with the invention this enables manifolding into four different coin tubes to be achieved within a height not much greater than that which is utilised for the purpose simply of separating the different coin denominations.

BRIEF DESCRIPTION OF THE DRAWINGS

In order that the invention may be more clearly understood, an embodiment thereof will now be described with reference to the accompanying drawings in which.

DETAILED DESCRIPTION OF THE INVENTION

Figure 1:
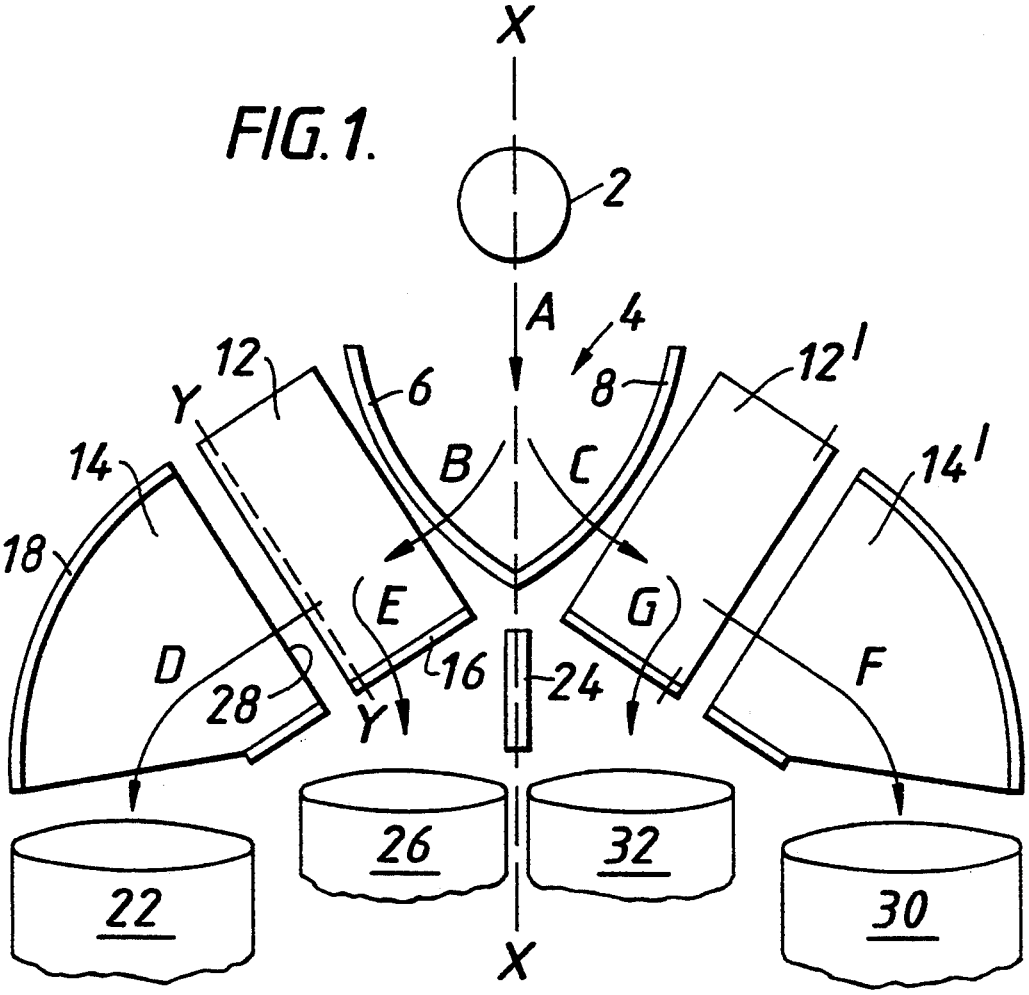
FIG. 1 is a front elevation of an apparatus for routing coins onto four paths in accordance with the invention.
Figure 2:
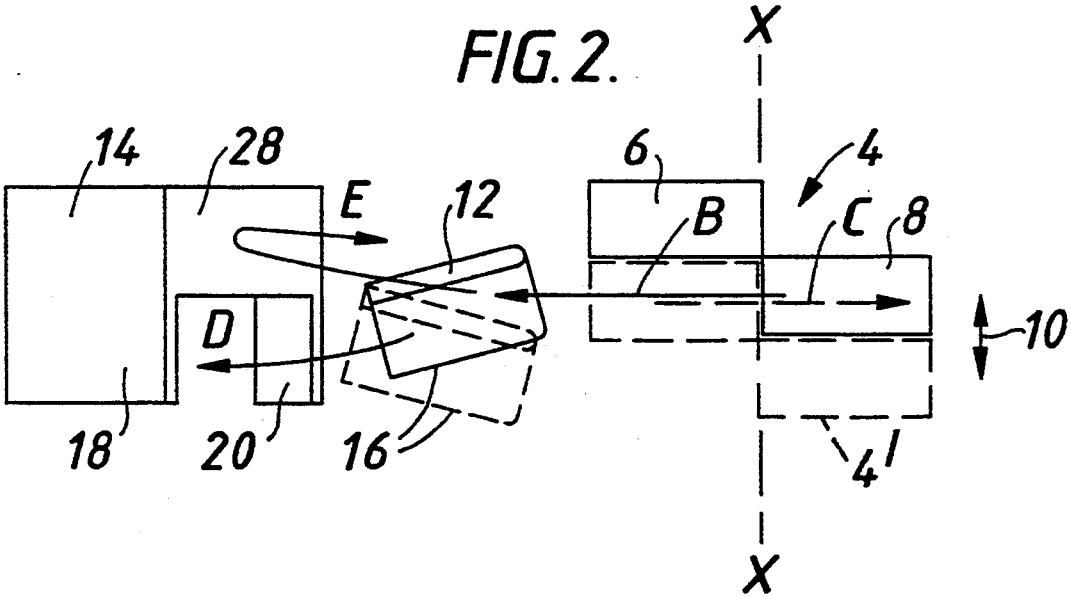
FIG. 2 is a partial top view of the same apparatus showing the components spread laterally for the purpose of clarity.

The apparatus is to a large extent symmetrical about a plane indicated by the broken lines X—X in FIGS. 1 and 2 and extending perpendicular to the plane of those drawings. FIG. 2 shows only the left-hand half fully.

A coin 2 travels vertically and substantially in the plane of FIG. 1 on an initial path A into the apparatus from, for example, the valid coin outlet of an electronic coin validator.

The coin first enters a generally V-shaped gate indicated at 4 which comprises two coin deflectors 6 and 8 formed as a unitary part and which form the V. Looking down on gate 4, as in FIG. 2, it can be seen that the deflectors 6 and 8 are displaced relative to each other in a direction substantially perpendicular to the plane of the V. The gate is also movable in that same direction between the position shown in full lines in FIG. 2 and the position shown in broken lines at 4' in FIG. 2, movement being along the direction of the double-headed arrow 10. The mounting of the gate for such movement, and the arrangement of a solenoid which can impose that movement selectively, are well within the competence of an engineer skilled in the art and therefore need not be described in detail.

When gate 4 is in its full-line position an arriving coin 2 will be deflected leftwards onto path B by deflector 8 as will be clear from FIG. 2. When gate 4 is in the broken-line position, the coin will be deflected to the right on path C, which path is shown in broken lines in FIG. 2.

Referring to FIG. 1, in can be seen that when a coin is initially deflected onto path B, it will next encounter a flap 12 followed by a component 14. Illustration of these components exactly as seen from above is difficult, and the results unclear, because they would to a substantial effect be overlapping each other. For the purpose of the top view in FIG. 2, the flap 12 is shown displaced to the left so that it is clear of deflector 6, rather than partially below it, and similarly component 14 is shown displaced to the left relative to flap 12, so that it is spaced from the flap rather than bellow it.

Flap 12 is pivoted about an axis Y which is close to its trailing end. It is actuated between two positions, namely the positions shown respectively in full lines and in broken lines in FIG. 2, by means of a solenoid. The solenoid and its coupling to the gate need not be shown because they are well within the capabilities of an engineer skilled in the art. At the bottom of flap 12, and integral and movable with it, there is a coin support 16 in the form of a projection or shelf along the lower edge of the flap and substantially at right angles thereto. Component 14 includes an outer guide wall 18 and an inner guide wall 20 which both protrude in a direction perpendicular to the plane of FIG. 1, as can be seen in FIG. 2.

When V-shaped gate 4 has been set to deflect a coin onto path B, and flap 12 is set to the full line position, then deflector 8, coin support 16 and inner guide 20 effectively form an uninterrupted coin track so that the coin will, because of the position of flap 12, roll in front of flap 12 (as viewed in FIG. 1) along the coin support 16 onto guide 20, following path D which leads it to a coin tube 22.

When the V-shaped gate 4 is in the same position, but the flap 12 is shifted to the broken-line position as shown in FIG. 2, then the coin on path B will pass behind flap 12 as viewed in FIG. 1 and, as it does so, leaving the lower end of deflector 8 it finds itself above an opening lying between inner guide 20 and a central partition 24 shown in FIG. 1, through which opening it drops on path E into coin tube 26. To ensure that the coin falls through this opening, component 14 is provided with a wall 28 which faces a coin passing behind flap 12 on path B so that the coin will hit the wall and drop down it on path E.

As has been mentioned, when the V-shaped gate 4 is switched to the broken-line position in FIG. 2, the coin 2 will initially take path C. Along that path lie flap 12' and component 14' which are equivalent to flap 12 and component 14 already described. Hence, by appropriate actuation of flap 12' the coin can be routed either on path F to coin tube 30 or on path G to coin tube 32.

It will be understood that in the arrangement described above, each time two paths diverge from each other, they do so by a substantial angle, substantially in the plane of FIG. 1, and hence over a short vertical distance the paths become widely spaced apart. This enables the coins to be distributed or manifolded into respective different tubes 22, 26, 32 and 30 for respective different denominations, within a vertical dimension not very much greater than that which would be required merely to separate (but not additionally distribute or manifold) the coins in most widely used prior coin handling systems.

Of course, the apparatus shown additionally requires front and rear walls, lying generally in planes parallel to FIG. 1, so as to prevent coins from being able to escape from the apparatus in directions perpendicular to that Figure. Such front and rear walls may in fact be made integral with the components 14 and 14' and include respective slots in which deflector 6 can be accommodated when the V-shaped gate 4 is in the full line position of FIG. 2, deflector 8 can be accommodated when the gate 4 is in the broken-line position of FIG. 2, and the coin support 16 can be accommodated when the flap 12 is in the broken-line position of FIG. 2. The design and provision of such walls to prevent coins escaping in devices of this general kind is well within the ability of those skilled in the art and to seek to illustrate them in the Figures would confuse rather than clarify them.

I claim:

1. A device for selectively routing coins moving edgewise along an initial plane defined by the coin on to either of two paths, the device comprising a flap which is pivotable about an axis such that its upstream end is selectively moveable between two positions, one on each side of the initial plane, to cause the coin to go either to one side or to the other side of the flap, an electrically powered actuator for selectively moving the flap between the two positions, a coin support arranged to support, from below and at its edge, a coin going to said one side of the flap, so that the coin continues edgewise and on edge on the support past the flap, and an opening into which a coin going to said other side of the flap will fall edgewise, wherein a coin going to said other side of the flap will begin to fall at a position upstream of the pivot axis.

2. A device as claimed in claim 1 comprising a wall which faces a coin going to said other side of the flap so that the coin will hit the wall and fall into said opening.

3. A device as claimed in claim 1, wherein the support is generally perpendicular to the flap.

4. A device as claimed in claim 1 wherein said coin support moves with said flap as the flap is moved between its two positions.

5. A device as claimed in claim 4, wherein said coin support extends from a peripheral edge portion of said flap.

6. A device as claimed in claim 4, wherein the support is integrally formed with said flap.

7. Apparatus for selectively routing coins comprising:

an initial path;

first and second intermediate paths diverging from the initial path;

means for selectively directing coins from the initial path onto either the first or second intermediate path a first flap associated with the first intermediate path, the first flap comprising an upstream end, and a first axis about which the flap can pivot into a first position in which the upstream end is on one side of a plane defined by a coin moving along the first intermediate path and a second position in which the upstream end is on the other side of the plane; and a second flap associated with the second intermediate path, the second flap comprising an upstream end and a pivot axis about which the flap can pivot into a first position in which the upstream end is on one side of a plane defined by a coin moving along the second intermediate path and a second position in which the upstream end is on the other side of the plane;

wherein the first and second flap can be selectively moved between their first and second positions;

the first and second flaps further comprising a coin support extending to one side from an edge of the flap such that a coin deflected by the flap to that side is supported; and an opening upstream of each pivot axis, proximate another side of each flap, such that a coin deflected to the other side begins to fall into the opening, upstream of the pivot axis.

8. Apparatus as claimed in claim 7, wherein said means for selectively directing comprises a generally V-shaped gate comprising two coin deflectors which form two sides of the V-shape, and the gate being moveable to place a selected one of the deflectors in the path of an arriving coin to deflect the coin past the other deflector on to either the first or second intermediate path.

9. A device as claimed in claim 7, wherein the means for selectively directing comprises a generally V-shaped gate comprising two gate deflectors which form two sides of the V-shape, the deflectors being displaced one forward of the other, and the gate being moveable to place a selected one of the deflectors in the path of an arriving coin to deflect the coin past the other deflector and onto a respective one of said two intermediate paths.

10. An apparatus for selectively routing coins moving edgewise on to any of four receiving paths, comprising:

an initial path;

first and second intermediate paths which diverge from the initial path;

means for selectively directing coins on to either of the first or second intermediate paths;

a first flap positioned proximate the first intermediate path;

a second flap positioned proximate the second intermediate path;

the first and second flaps each having an upstream end and an axis, the first and second flaps being pivotable about their axis such that their upstream ends are selectively moveable between two positions, one on each side of an initial plane defined by a coin in the respective first or second intermediate path, to cause the coin to go to either one side or to the other side of the flap; and the apparatus further comprising a coin support arranged to support, from below and at its edge, a coin going to the one side of the flap so that the coin continues edgewise and on edge on the support past the flap, and an opening into which a coin going to the other side of the flap will fall edgewise.

* * * * *

UNITED STATES PATENT AND TRADEMARK OFFICE

CERTIFICATE OF CORRECTION

PATENT NO. : 5,390,776

DATED : February 21, 1995

INVENTOR(S) : Thompson, T.

It is certified that error appears in the above-identified patent and that said Letters Patent is hereby corrected as shown below:

Col. 1, line 50, after "of the flap", insert --,--.

Col. 3, line 36, delete "bellow" and insert --below--.

Signed and Sealed this

Twenty-third Day of September, 1997

*Attest:*

Bruce Lehman

BRUCE LEHMAN

*Attesting Officer*

*Commissioner of Patents and Trademarks*